US005156894A

United States Patent [19]

Hood et al.

[11] Patent Number: 5,156,894

[45] Date of Patent: Oct. 20, 1992

[54] HIGH PERFORMANCE, THERMALLY INSULATING MULTIPANE GLAZING STRUCTURE

[75] Inventors: Thomas G. Hood, San Francisco; Steve M. Vincent, Union City; Robin Booth, Mountain View, all of Calif.

[73] Assignee: Southwall Technologies, Inc., Palo Alto, Calif.

[21] Appl. No.: 389,231

[22] Filed: Aug. 2, 1989

[51] Int. Cl.[5] ..... F06B 3/24

[52] U.S. Cl. ..... 428/34; 428/192; 428/219; 428/314.4; 428/340; 156/109; 52/788; 52/789; 52/790

[58] Field of Search ..... 428/34, 192, 219, 314.4, 428/332, 340, 423.1; 156/107, 109; 52/171, 172, 788–790

[56] References Cited

U.S. PATENT DOCUMENTS

| | | | |
|---|---|---|---|
| 4,242,386 | 12/1980 | Weinlich | 428/34 |
| 4,334,398 | 6/1982 | Grether | 52/789 |
| 4,368,226 | 1/1983 | Mucaria | 428/34 |
| 4,563,843 | 1/1986 | Grether et al. | 428/34 |
| 4,721,636 | 1/1988 | Hood et al. | 428/38 |
| 4,831,799 | 5/1989 | Glover et al. | 428/34 |

*Primary Examiner*—Ellis P. Robinson
*Assistant Examiner*—Donald J. Loney
*Attorney, Agent, or Firm*—Morrison & Foerster

[57] ABSTRACT

Multipane, insultating glazing structures having exceptional thermal insulation performance are provided. The novel multipane structures comprise two substantially parallel rigid glazing sheets spaced apart by an interior spacer of a low thermal conductivity, closed cell, foamed polymer. In a preferred embodiment, the glazing sheets are present in a four-pane structure filled with an inert gas and sealed with a gas-impermeable, continous tape overlaying a curable, high modulus sealant. Methods for manufacturing the novel glazing structures are disclosed as well.

30 Claims, 4 Drawing Sheets

SURFACE NUMBERING

HIGH PERFORMANCE, THERMALLY INSULATING MULTIPANE GLAZING STRUCTURE

TECHNICAL FIELD

The present invention relates generally to multipane glazing structures, and more particularly relates to a novel multipane glazing structure which has exceptional thermal insulation performance. The invention also relates to interpane spacers and to a novel sealing system for use in the multipane structure.

BACKGROUND

Multipane glazing structures have been in use for some time as thermally insulating windows, in residential, commercial and industrial contexts. Examples of such structures may be found in U.S. Pat. Nos. 3,499,697, 3,523,847 and 3,630,809 to Edwards, 4,242,386 to Weinlich, 4,520,611 to Shingu et al., and 4,639,069 to Yatabe et al. While each of these patents relates to laminated glazing structures which provide better insulation performance than single-pane windows, increasing energy costs as well as demand for a superior product have given rise to a need for windows of even higher thermal insulation ability.

A number of different kinds of approaches have been taken to increase the thermal insulation performance of windows. Additional panes have been incorporated into a laminated structure, as disclosed in several of the above-cited patents; typically, incorporation of additional panes will increase the R-value of the structure from R-1 for a single-pane window to R-2 for a double laminate, to R-3 for a structure which includes 3 or more panes (with "R-values" defined according to the insulation resistance test set forth by the American Society for Testing and Materials in the *Annual Book of ASTM Standards*). Southwall Technologies Inc., the assignee of the present invention, has promoted such a triple-glazing structure which employs two glass panes containing an intermediate plastic film. Such products are described, for example, in U.S. Pat. No. 4,335,166 to Lizardo et al.

In addition, heat-reflective, low-emissivity ("low e") coatings have been incorporated into one or more panes of a window structure, increasing the R-value to 3.5 or higher. Such a heat-reflective coating is described, for example, in U.S. Pat. No. 4,337,990 to Fan et al. (which discloses coating of a plastic film with dielectric/-metal/dielectric induced transmission filter layers). Window structures which include heat-reflective coatings are described in U.S. Pat. Nos. 3,978,273 to Groth, 4,413,877 to Suzuki et al., 4,536,998 to Matteucci et al., and 4,579,638 to Scherber.

Still another and more recent method which has been developed for increasing the thermal insulation performance of windows is the incorporation, into the window structure, of a low heat transfer gas such as sulfur hexafluoride (as described in U.S. Pat. No. 4,369,084 to Lisec), argon (as described in U.S. Pat. Nos. 4,393,105 to Kreisman and 4,756,783 to McShane), or krypton (also as disclosed in McShane '783). These gas-filled laminated windows are reported to have total window R-values of 4 or 5, with the total window R-value approximating the average of the center-of-glass and edge area R-values (Arasteh, "Superwindows., in *Glass Magazine,* May 1989, at pages 82–83).

Despite the increasing complexity in the design of insulating window structures, total window R-values have not surpassed 4 or 5. While not wishing to be bound by theory, the inventors herein postulate several reasons for the limited insulating performance of prior art window structures: (1) thermal conductance across interpane metal spacers present at the window edge; (2) thermal conductance within and across the edge sealant; and (3) the impracticality, due to considerations of window weight and thickness, of having a large number of panes in a single glazing structure.

The present invention addresses each of the aforementioned problems and thus provides a novel multipane window structure of exceptionally high thermal insulating performance.

In addition to insulating performance, the following characteristics are extremely desirable in a window structure and are provided by the present invention as well:

- durability under extremes of temperature;
- resistance of internal metallized films to yellowing;
- resistance to condensation, even at very low temperatures;
- low ultraviolet transmission; and
- good acoustical performance, i.e., sound deadening within the multilaminate structure.

Citation of Prior Art

In addition to the references noted in the preceding section, the following patents and publications relate to one or more aspects of the present invention.

Multipaned glazing units: U.K. Patent Application Publication No. 2,011,985A describes a multiple glazed unit containing one or more interior films. The unit may in addition include sound damping materials and a gas filling. U.S. Pat. No. 4,687,687 to Terneu et al. describes a structure containing at least one sheet of glazing material coated with a layer of a metallic oxide. U.S. Pat. No. 2,838,809 to Zeolla et al. is a background reference which describes multiple glazing structures as windows for refrigerated display cases. U.S. Pat. Nos. 4,807,419 to Hodek et al. and 4,815,245 to Gartner also relate to multiple pane window units.

Gas filling of interpane spaces: U.S. Pat. Nos. 4,019,295 and 4,047,351 to Derner et al. disclose a two-pane structure containing a gas filling for acoustic insulation purposes. U.S. Pat. No. 4,459,789 to Ford describes a multi-pane, thermally insulating window containing bromotrifluoromethane gas within the interpane spaces. U.S. Pat. No. 4,604,840 to Mondon discloses a multipane glazing structure containing a dry gas such as nitrogen in its interpane spaces. U.S. Pat. No. 4,815,245 to Gartner, cited above, discloses the use of noble gases to fill interpane spaces.

Spacers: U.S. Pat. Nos. 3,935,351 to Franz, 4,120,999 to Chenel et al., 4,431,691 to Greenlee, 4,468,905 to Cribben, 4,479,988 to Dawson and 4,536,424 to Laurent relate to spacers for use in multipane window units.

Sealants: U.S. Pat. Nos. 3,791,910 to Bowser, 4,334,941 and 4,433,016 to Neely, Jr., and 4,710,411 to Gerace et al. describe various means for sealing multipane window structures.

SUMMARY OF THE INVENTION

It is a primary object of the invention to address the above-noted deficiencies of the prior art and thus to provide a multipane window structure of exceptionally high thermal insulation performance.

It is another object of the invention to provide such a multipane window structure which has excellent acoustical performance, is resistant to yellowing and condensation, is durable under extremes of temperature, and is less than about 2% transmissible to ultraviolet light.

It is still another object of the invention to provide a novel interior spacer for use in such a multipane window structure.

It is a further object of the invention to provide a novel sealing system for use in such a multipane window structure.

Additional objects, advantages and novel features of the invention will be set forth in part in the description which follows, and in part will become apparent to those skilled in the art upon examination of the following, or may be learned by practice of the invention.

In a first aspect of the invention, a multipane glazing structure comprises at least two substantially parallel sheets of glazing held in spaced relationship to each other by a peripheral spacer, said spacer comprised of a closed cell foamed polymer having a thermal conductivity of less than about 0.8 $BTU \times in/ft^2 \times hr \times ^\circ F(max)$, as measured by ASTM Test C518.

In a second aspect of the invention, a multipane glazing structure is provided as above, and further includes a peripheral seal surrounding and enclosing the edges of the glazing sheets and the spacers, the peripheral seal comprising (a) a layer of curable sealant adhered to the edges of the sheets of glazing and to the outer surface of the spacers, and (b) a continuous gas-impermeable tape adhered to and overlaying the layer of sealant. In a preferred embodiment, the polymeric spacer extends beyond the edges of the glazing sheets to the exterior tape so as to provide a thermal break within the sealant.

In a final aspect of the invention, a high performance, thermally insulating glazing structure is provided which comprises:

four distinct, substantially parallel glazing sheets, each spaced apart from the others by peripheral spacers, wherein the first and fourth of the sheets are glass and represent the exterior faces of said structure, and wherein the second and third of the sheets are transparent plastic, and are contained on the interior of the structure, the second and third of the sheets being separated from one another by a spacer comprised of a closed cell foamed polymer having a thermal conductivity of less than about 0.8;

a gas selected to reduce heat conductance contained between the first and fourth sheets; and a peripheral seal surrounding and enclosing the edges of the sheets of glazing and the spacers, the seal comprising a layer of curable sealant adhered to the sheets of glazing and the outer surface of the spacers, and a continuous gas-impermeable tape adhered to and overlaying the layer of sealant.

DETAILED DESCRIPTION OF THE INVENTION

Figure 1:
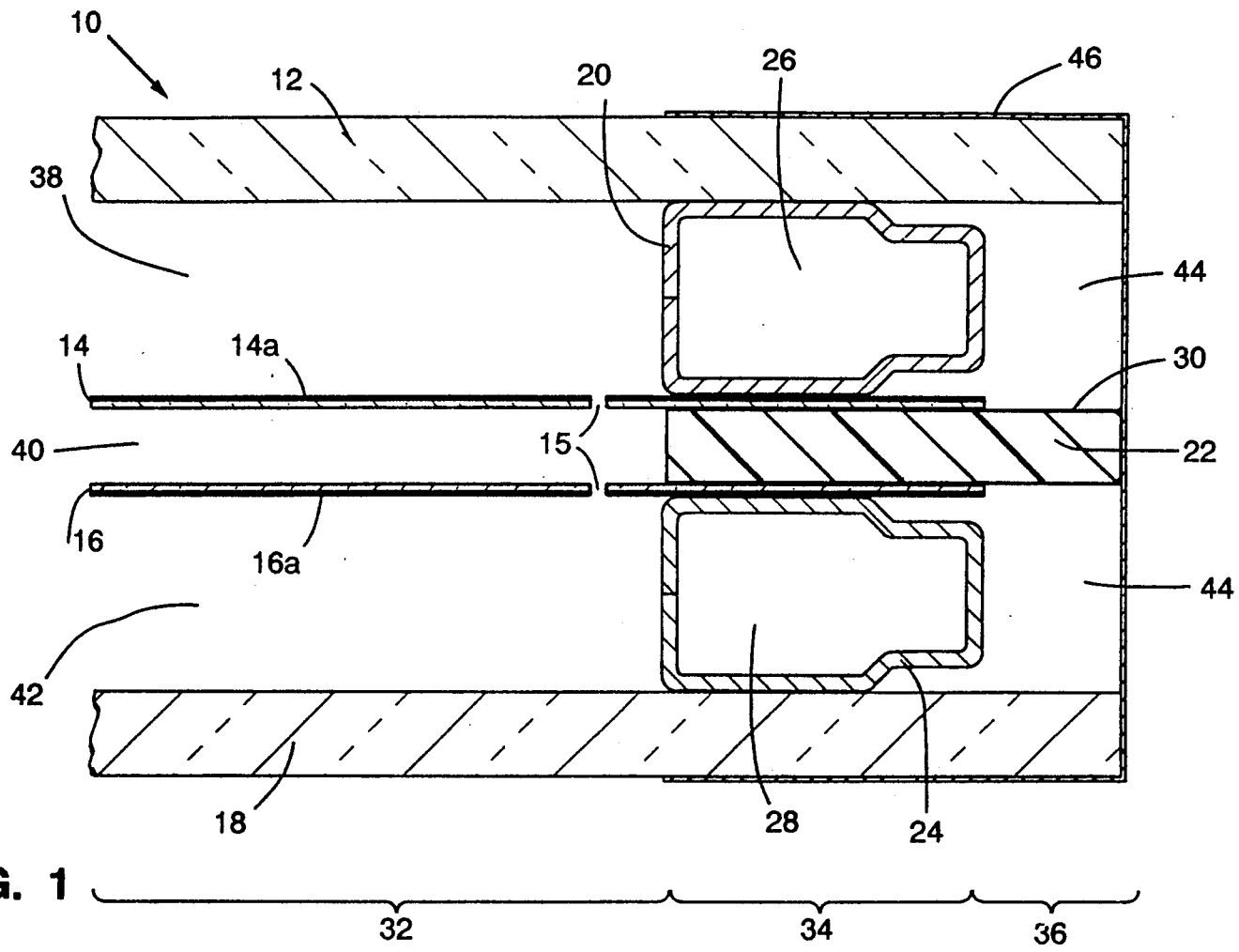
FIG. 1 is a schematic cross-sectional representation of a multipane glazing structure of the invention.

The glazing structures of the invention include two substantially parallel rigid sheets of glazing spaced apart from each other by a peripheral polymeric spacer. It is preferred that these glazing sheets (designated as elements 14 and 16 in FIG. 1) be contained within a multipane window structure assembled and sealed as illustrated in FIG. 1.

Turning now to that Figure, a multipane window structure according to the invention is shown generally at 10. The multipane structure contains four distinct, substantially parallel glazing sheets 12, 14, 16 and 18 spaced apart from one another by spacers 20, 22 and 24. The first and fourth glazing sheets 12 and 18, which represent the exterior panes of the structure, can be of a rigid plastic material such as a rigid acrylic or polycarbonate, but more commonly these sheets are glass. Depending on architectural preference, one or both of these glass panels can be coated, tinted or pigmented. This can be done to enhance appearance, to alter light-transmission properties, to promote heat rejection, to control ultraviolet transmission, or to reduce sound transmission. Bronze, copper or grey tints are often applied to the outer of the two glass panels. The outer glazing sheets 12 and 18 can also be of a special nature, e.g., laminated; tempered, etc. Typically, the thickness of these outer sheets will be in the range of about 1/16"to about ¼.

Interior glazing sheets 14 and 16 are preferably comprised of flexible plastic sheets, although, like the outer glazing sheets, they can also be comprised of glass or coated glass. If plastic, the material should be selected so as to have good light stability so that it will withstand the rigors of prolonged sun exposure. This plastic should also be selected so as not to be substantially susceptible to outgassing, which could lead to deposits on the inner surfaces of the glass layers and interfere with optical clarity. Polycarbonate materials and the like can be used, but there is a preference for the polyesters, such as polyethylene terephthalate (PET). These interior plastic films are relatively thin as compared with other typical window-film materials. Thicknesses above about 1 mil (0.001") are generally used, with thicknesses in the range of about 2 mil to about 25 mil being preferred and thicknesses in the range of about 2 mil to 10 mil being more preferred.

It is preferred that one or both of the interior glazing sheets 14 and 16 be provided with one or more apertures 15 to enable equalization of pressure between the interpane gas spaces. Such apertures also allow desiccant present in the exterior spacers to absorb vapor from central interpane space 40 as well as from exterior spaces 38 and 42.

It is also preferred that one or both of the interior glazing sheets 14 and 16 be coated on one or both of their sides with heat-reflective layers as known in the art (elements **14*a* and 16*a*, respectively, in FIG. 1**) and as exemplified in U.S. Pat. No. 4,337,990 to Fan et al., cited hereinabove. Preferably, only one such coating is present per interpane gas space; highest thermal insulation values are obtained in this way. Such coatings can be designed to transmit from about 40% to about 90% of the visual light impacting them. It is particularly preferred to use as such coatings a dielectric/metal/dielectric multilayer induced transmission filter as described in co-pending, commonly assigned U.S. patent application Ser. No. 143,728, filed Jan. 14, 1988. These layers can be laid down by magnetron sputtering techniques which are known to the art. Southwall markets a range of induced transmission heat reflective film products under its HEAT MIRROR trademark. These materials have various thicknesses of metal (often silver) sandwiched between layers of dielectric and are designed to give substantial heat reflection and typically transmit from about 10 to 90% of total visible light.

Exterior spacers 20 and 24 may be selected from a wide variety of commercially available materials. These exterior spacers are typically metallic as is well known in the art, or they may be fabricated from a synthetic polymeric material as used for interior spacer 22 (described below). Exterior spacers 20 and 24 are generally fabricated so as to have interiors 26 and 28 containing desiccant in order to prevent build-up of moisture between the layers. The desiccant may or may not be present in a polymeric matrix contained within interiors 26 and 28. The exterior spacer structures of FIG. 1 are merely representational; generally rectangular or square cross sections will be employed.

As noted above, interior spacer 22 is comprised of a closed cell foam polymer having a thermal conductivity of less than about 0.8, preferably less than about 0.5, most preferably less than about 0.2. The material also has a compressive strength of at least about 100 psi; to this end, the material preferably has a density of at least about 3.0 $lb/ft^3$, typically in the range of about 3.0 to about 6.0 $lb/ft^3$. The material should not be such that it outgasses significantly, and should, in general, be chemically and physically stable. Exemplary materials for use as interior spacer 22 include foamed polyurethanes, foamed polycarbonate, foamed polyvinyl chloride (PVC) modified so as to prevent outgassing (e.g., using a steam process as known in the art), or synthetic thermoplastic resins manufactured under the trademark "Noryl" (polyphenylene oxide) by the General Electric Corporation.

It is preferred that the exposed surfaces of the foam spacer be covered in metallic foil 30 to ensure that gas loss from the spacer is minimized and to protect the spacer from ultraviolet rays. Foil 30 is typically comprised of aluminum, silver, copper or gold. Generally, metal foil 30 will have a thickness in the range of 0.5 to 3 mils.

Interpane voids 38, 40 and 42 which result from the spacing apart of the four glazing sheets are filled with a gas selected to reduce heat conductance across the window structure. Virtually any inert, low heat transfer gas may be used, including krypton, argon, sulfur hexafluoride, carbon dioxide, or the like, at essentially the atmospheric pressure prevailing at the location of use of the window unit. It is particularly preferred that the gas filling have a high krypton content, of at least about 10%, more preferably at least about 25%, most preferably at least about 50%, depending on the thickness of the window structure (thicker windows, clearly, do not require as high a krypton content; see the Example).

It is also preferred that the filling gas contain some appreciable amount of oxygen (preferably in the range of about 1% to 10% by volume, more preferably in the range of about 2% to 5% by volume). Incorporation of oxygen into the filling gas tends to prevent or minimize yellowing of the interior plastic glazing sheets.

Sealant 44 is present between glazing sheets 12 and 18 at their edges. This sealant should be a curable, high-modulus, low-creep, low-moisture-vapor-transmitting sealant. It should have good adhesion to all of the materials of construction (i.e., metal or plastic, glass, metallized interior films, and the like). Polyurethane adhesives, such as the two-component polyurethanes marketed by Bostik (Bostik "3180-HM" or "3190-HM"), are very suitable.

The peripheral seal of window structure 10 is formed both by sealant 44 and by continuous layer 46 of a gas-impermeable tape which adheres to and overlays the sealant. The tape is preferably comprised of a multilayer plastic packaging material which acts as a retaining barrier for the gas filling in the window structure. The tape is of a material selected so as to be hydrolytically stable, resistant to creep, and, most importantly, highly resistant to vapor transmission. Exemplary materials useful as tape 46 include metal-backed tapes in general as well as butyl mastic tapes, mylar-backed tapes, and the like. It is particularly preferred that the adhesive component of the tape be a butyl adhesive. The thickness of the sealing tape is preferably in the range of about 5 to 30 mils.

The peripheral seal formed by the curable sealant-/gas-impermeable tape system ensures that there is virtually no gas leakage from the window, on the order of 1% per year or less. This is in contrast to prior art methods of sealing gas-filled glazing structure, which can result in gas leakage as high as 20% to 60% per year.

As may be deduced from FIG. 1, thermal conductivity across the window structure may occur in three regions: across the central portion 32 of the window; across the metallic edge spacers, identified as region 34 in the Figure; or through the very edge of the structure, across the sealant (identified as region 36 in the Figure). The present invention reduces the thermal conductivity in all three of these regions, and thus improves insulation performance while significantly reducing the problem of condensation.

With respect to region 32, the central portion of the window, thermal conductivity is substantially reduced by the presence of the selected gas present within the interpane voids as well as by the presence of coatings **14*a* and/or 16*a***.

With respect to region 34, conductivity across the exterior metallic spacers is significantly reduced by the presence of interior spacer 22 which has, as noted above, very low conductivity.

With respect to region 36, conductivity across sealant 44 is significantly reduced by interior spacer 22, which, as shown, extends to the very edge of the glazing structure so that its end extends beyond the edges of the interior glazing sheets and is aligned with the edges of exterior sheets 12 and 18. Extension of interior spacer 22 in this way provides an important and virtually complete thermal break at the edge of the glazing structure so as to substantially reduce thermal conductivity across and through the sealant 44. This aspect of the invention significantly improves insulation performance and resistance to condensation.

Manufacturing method: In the preferred mode of production, the window structures of the invention are assembled by first affixing inner glazing sheets 14 and 16 coated with heat-reflecting films **14*a* and 16*a* to outer spacers 22 and 24, respectively, using double-sided adhesive tape. Spacers 22 and 24 are hollow and contain desiccant. Outer glass panes 12 and 18 are joined to their respective outer spacers 22 and 24, again with double-sided tape, to give a pair of glass-spacer-film subassemblies. These two subassemblies are then joined using foam spacer 22 and additional adhesive tape, so that the pane edges and the gas fill holes in the outer metal spacers are aligned. The edge of foam spacer 22 extends out beyond the edges of sheets 14 and 16 and is aligned with the edges of the outer panes 12 and 18 as shown in FIG. 1. Sealant 44 is introduced at the pane edges and allowed to cure; at this point the window units are subjected to a heat treatment. Typically, temperatures in the range of about 80° C. to about 120° C. are used. The heating period is generally about 30 minutes, although longer times are required at lower temperatures, and shorter times may be sufficient at higher temperatures. This heat treatment serves to cure the sealant 44 and shrink the internal plastic films 14 and 16 to a taut condition. Interpane gas spaces are then filled. The method of filling the structures with gas should be such that efficiency is maximized and gas loss is minimized. In a particularly preferred method of introducing the filling gas, delivery is carefully controlled, i.e., a timing device is used and the flow rate monitored so that filling will be stopped at a given volume. The gas fill mix is adjusted depending on the thickness of the window structure and on the desired R-value and introduced into the interpane gas structures using the desired method. The structure is re-sealed as above. The selected barrier tape 46 is then applied over the pane edges and sealant as illustrated in FIG. 1**.

Overview of performance characteristics: Window structures of the present invention may be characterized as having:

- center-of-glass R-values of at least about R-4, and, depending on the construction of the window structure, R-values of R-6 or R-7 or even higher;
- excellent condensation resistance (no ice formation and minimal condensation will occur at conditions of −20° F. outside and +70° F., 40% R.H. inside);
- gas leakage of less than about 1% per year;
- uv transmission (300 to 380 nm) of 1% or
- excellent acoustical performance; and
- significant reduction in yellowing (less than 2.0% Y.I.D. change over 5000 hr as measured by ASTM Test D 882/G 53).

It is to be understood that while the invention has been described in conjunction with the preferred specific embodiments thereof, that the foregoing description as well as the example which follows is intended to illustrate and not limit the scope of the invention. Other aspects, advantages and modifications within the scope of the invention will be apparent to those skilled in the art to which the invention pertains.

EXPERIMENTAL

Figure 2:
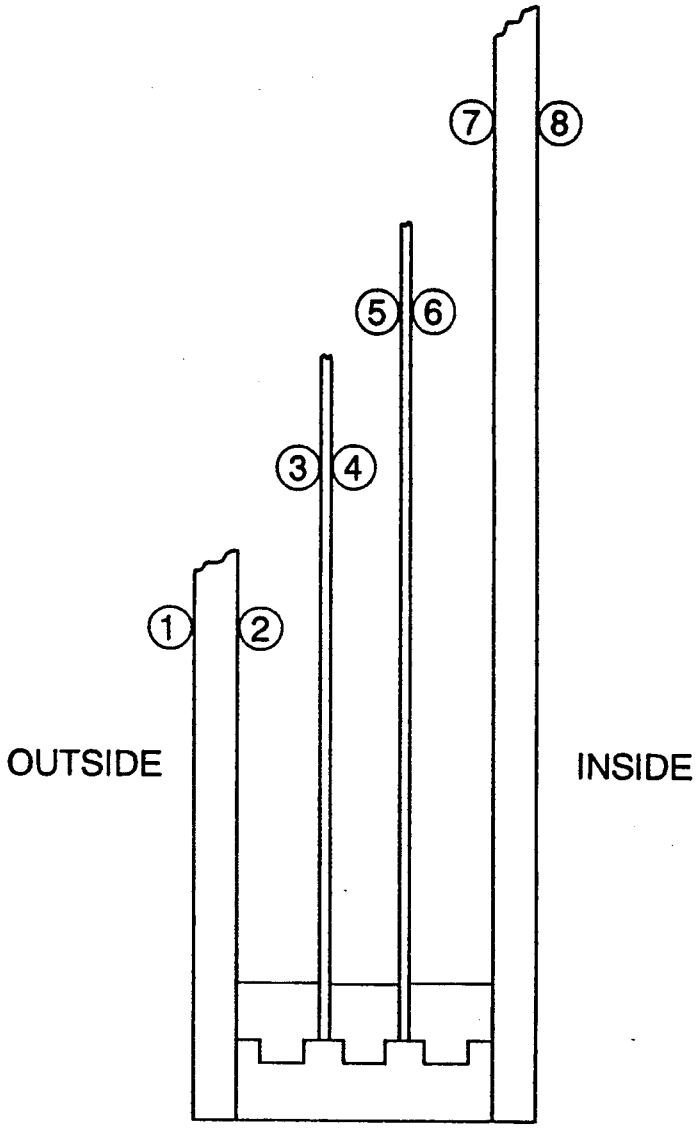
FIG. 2 is also a schematic cross-sectional representation of a multipane glazing structure of the invention, and illustrates the surface numbering scheme used in the Examples.

In Examples 1 and 2, center-of-glass R-values were evaluated for various multipane glazing structures using a computer simulation technique (Lawrence Berkeley Laboratory's Window 3.1). The structures simulated for purposes of these examples were multipane units comprising: interior panes of polyethylene terephthalate coated on their exterior surfaces (surfaces 3 and 6 in FIG. 2) with heat-reflective, "low e" coatings of silver and indium oxide; exterior glass panes; and an interior spacer of a foamed polyurethane. Air gaps, spacer widths, content of the filling gas, and number of low e coatings were among the variables evaluated in Examples 1-2 In Example 3, actual multipane glazing structures were fabricated and tested as described.

EXAMPLE 1

Figure 3:
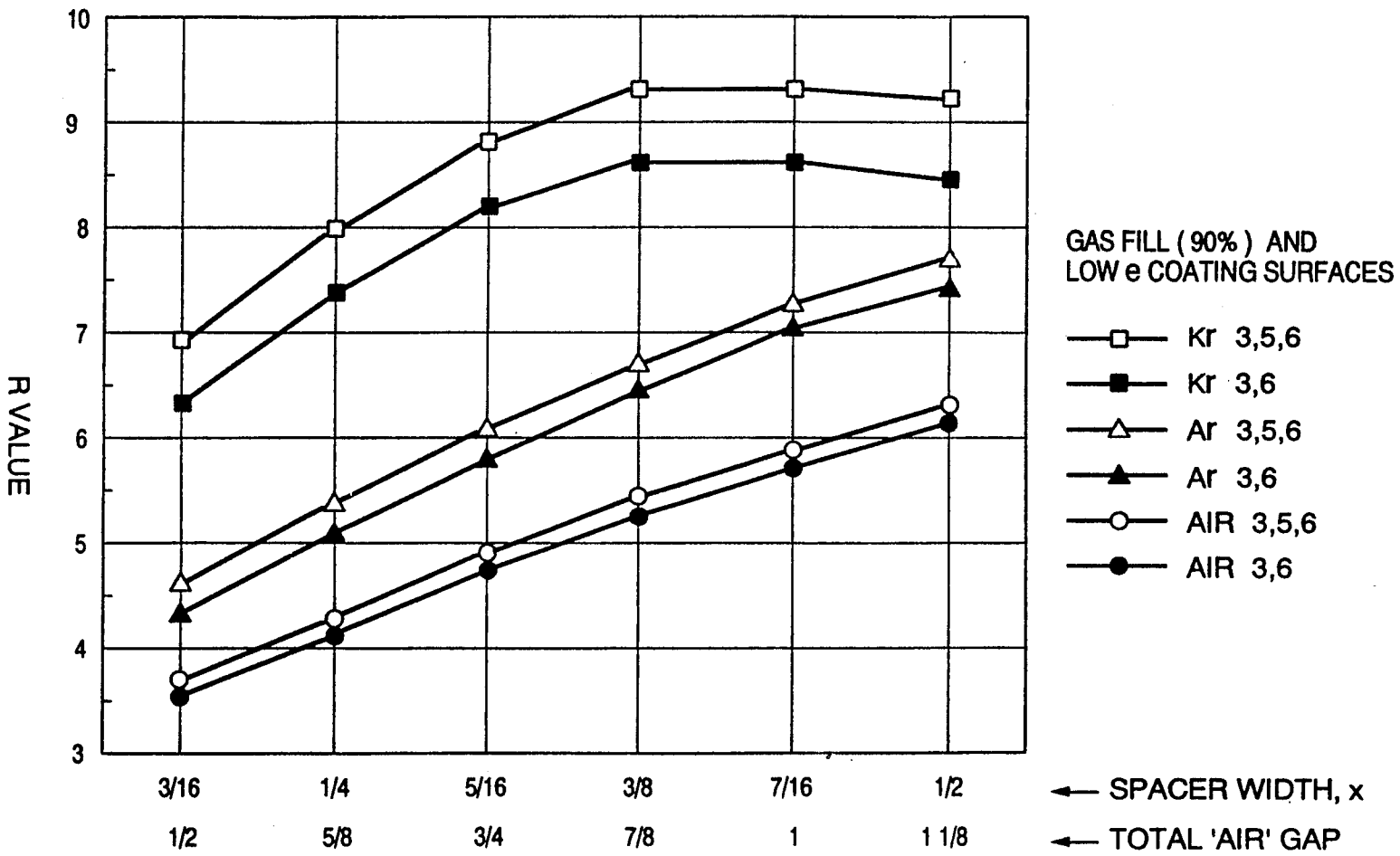
FIG. 3 is a graph illustrating the correlation between center-of-glass R-values, type of gas filling, and overall air gap, as evaluated in Example 1.

The glazing structures modeled and evaluated in this example had (1) exterior, metallic spacers of varying widths, (2) varying total "air" gaps, and (3) varying gas filling (90% krypton/10% air, 90% argon/10% air, or 100% air), as indicated in the legend to FIG. 3. Center-of-glass R-values versus total air gap were plotted in FIG. 3; as may be deduced from the graph, R-values were highest for glazing structures filled with 90% krypton Also, as expected, R-values were generally higher for glazing structures having a higher total air gap.

EXAMPLE 2

Figure 4:
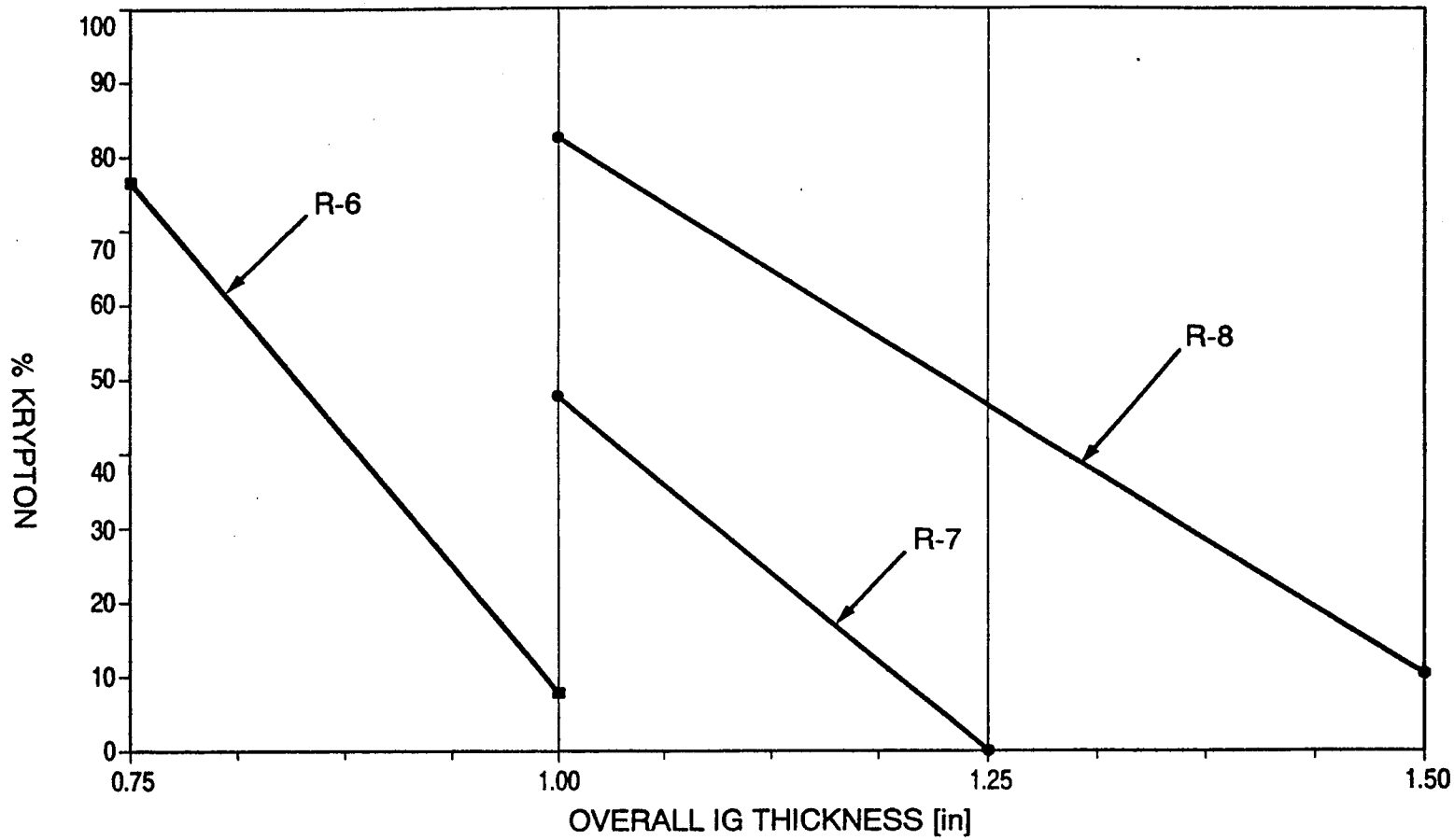
FIG. 4 is a graph illustrating the correlation between center-of-glass R-values, krypton content, and overall thickness, as evaluated in Example 2.

To evaluate the relationship of krypton content, overall thickness (from exterior surface 1 to exterior surface 8, in FIG. 2) and center-of-glass R-value, various multipane glazing structures were modeled and evaluated as indicated in FIG. 4. In these simulated structures, the gas filling was 10% air and the remainder containing varying amounts of krypton and argon. As in the preceding Examples, the interior panes were modeled as comprising PET coated on their exterior surfaces 3 and 6 with low e layers, while the insulating spacer was presumed to be of a foamed polyurethane, ⅛" thick, except for the 1.5 overall unit where it was ¼" thick. As illustrated in FIG. 4, higher R-values can be achieved at lower krypton contents where the overall structure is of a higher thickness; e.g., at a total thickness of 1.5", an R-value of R-8 can be achieved at a krypton content of only 10%. Correlatively, a relatively thin structure, 0.75" total thickness, can still provide a center-of-glass R-value of R-6 if the krypton content is high, i.e., 75%-80%.

EXAMPLE 3

Edge R-values were measured for several different multipane window structures, approximately 1" thick, fabricated as described in the preceding sections, except that the composition of the interior spacer was varied. A polyvinyl chloride spacer gave an edge R-value of 1.38, while a hollow aluminum spacer, an extruded butyl spacer, and a hollow fiberglass spacer gave edge R-values of 0.37, 0.56 and 0.68, respectively. As expected, the foamed polyvinyl chloride spacer, having a much lower thermal conductivity, gave the highest edge R-value.

I claim:

1. A multiplane window glazing structure comprising two substantially parallel sheets of glazing held in spaced relationship to each other by a peripheral spacer, said spacer comprised of a body of a physically stable closed cell foamed polymer sized to substantially span the spaced relationship and having a thermal conductivity of less than about 0.8.

2. The multipane window glazing structure of claim 1, wherein the thermal conductivity of the closed cell foamed polymer is less than about 0.5.

3. The multipane window glazing structure of claim 1, wherein the thermal conductivity of the closed cell foamed polymer is less than about 0.2.

4. The structure of claim 1, wherein the polymer is selected from the group consisting of foamed polycarbonate, polyurethane, polyphenylene oxide and polyvinyl chloride.

5. The structure of claim 4 wherein the polymer has a density of from about 3.0 lb/ft$^3$ to about 6 lb/ft$^3$.

6. The structure of claim 1, wherein the peripheral spacer extends beyond the edges of the parallel sheets of glazing.

7. The structure of claim 1, wherein the sheets of glazing are comprised of plastic films.

8. The structure of claim 7, wherein at least one of the plastic films carries a wavelength-selective, reflective coating on one of its surfaces.

9. The structure of claim 7, wherein the plastic films are comprised of polyethylene terephthalate.

10. The structure of claim 8, wherein the plastic films are comprised of polyethylene terephthalate.

11. A multiplane glazing structure comprising:

two or more substantially parallel sheets of glazing held in spaced relationship to one another by peripheral spacers, wherein at least one of said spacers if a body of physically stable closed cell foam polymer having a thermal conductivity of less than about 0.8 disposed between adjacent sheets; and a peripheral seal surrounding and enclosing the edges of said sheets and the spacers, said peripheral seal comprising (a) a layer of curable sealant adhered to the edges of the sheets of glazing and the outer surface of the spacers, and (b) a continuous gas-impermeable tape adhered to and overlaying said layer of sealant.

12. The multipane glazing structure of claim 11, wherein the sealant is a polyurethane.

13. The multipane glazing structure of claim 11, wherein a gas selected to reduce heat transfer is contained and enclosed within said structure.

14. The multipane glazing structure of claim 13, wherein said gas is selected from the group consisting of krypton, argon, sulfur hexafluoride, carbon dioxide, and mixtures thereof.

15. The multipane glazing structure of claim 13, wherein said gas further contains oxygen in an amount of about 1.0 to 10% by volume.

16. The multipane glazing structure of claim 15, wherein said gas contains oxygen in an amount of about 2.0 to 5.0% by volume.

17. The multipane window glazing structure of claim 11, wherein the thermal conductivity of the closed cell foamed polymer is less than about 0.5.

18. The multipane window glazing structure of claim 17, wherein the thermal conductivity of the closed cell foamed polymer is less than about 0.2.

19. The multipane glazing structure of claim 11, wherein the closed cell foam polymer is selected from the group consisting of foamed polycarbonate, polyurethane, polyphenylene oxide, and polyvinyl 20. The structure of claim 19 wherein the polymer has a density of from about 3.0 lb/ft$^3$ to about 6 lb/ft$^3$.

21. A high performance, thermally insulating glazing structure, said structure comprising:

four distinct, substantially parallel glazing sheets, each spaced apart from the others by peripheral spacers, wherein the first and fourth of said sheets are glass and represent the exterior faces of said structure, and wherein the second and third of said sheets are transparent plastic, and are contained on the interior of said structure, said second and third of said sheets being separated from one another by a spacer comprised of a physically stable closed cell foamed polymer sized to span the spaced relationship between the second and third sheets and having a thermal conductivity of less than about 0.8;

a gas selected to reduce heat conductance contained between said first and fourth sheets; and a peripheral seal surrounding and enclosing the edges of the sheets of glazing and the spacers, said seal comprising a layer of curable sealant adhered to the sheets of glazing and the outer surface of the spacers, and a continuous gas-impermeable tape adhered to and overlaying the layer of sealant.

22. The multipane glazing structure of claim 21, wherein the sealant is a polyurethane.

23. The multipane glazing structure of claim 21, wherein a gas selected to reduce heat transfer is contained and enclosed within said structure.

24. The multipane glazing structure of claim 23, wherein said gas is selected from the group consisting of krypton, argon, sulfur hexafluoride, carbon dioxide, and mixtures thereof.

25. The multipane glazing structure of claim 24, wherein said gas further contains oxygen in an amount of about 1.0 to 10% by volume.

26. The multipane glazing structure of claim 25, wherein said gas contains oxygen in an amount of about 2.0 to 5.0% by volume.

27. The multipane window glazing structure of claim 21, wherein the thermal conductivity of the closed cell foamed polymer is less than about 0.5.

28. The multipane window glazing structure of claim 27, wherein the thermal conductivity of the closed cell foamed polymer is less than about 0.2.

29. The multipane glazing structure of claim 21, wherein the closed cell foam polymer is selected from the group consisting of foamed polycarbonate, polyurethane, polyphenylene oxide, and polyvinyl chloride.

30. The structure of claim 21 wherein the polymer has a density of from about 3.0 lb/ft$^3$ to about 6 lb/ft$^3$.

* * * * *